US006196760B1

(12) United States Patent
Sinclair

(10) Patent No.: US 6,196,760 B1
(45) Date of Patent: Mar. 6, 2001

(54) ADJUSTMENT RISER

(76) Inventor: David Brent Sinclair, 60 Morgan Road, Baie d'Urfe, Quebec (CA), H9X 3A4

( * ) Notice: Subject to any disclaimer, the term of this patent is extended or adjusted under 35 U.S.C. 154(b) by 0 days.

(21) Appl. No.: 09/339,249

(22) Filed: Jun. 24, 1999

(51) Int. Cl.[7] ..... E02D 29/14
(52) U.S. Cl. ..... 404/26
(58) Field of Search ..... 404/25, 26; 52/19, 52/20; 277/944

(56) References Cited

U.S. PATENT DOCUMENTS

| | | | | |
|---|---|---|---|---|
| 4,103,901 | | 8/1978 | Ditcher . | |
| 4,592,674 | * | 6/1986 | Baliva | 404/25 |
| 4,759,656 | * | 7/1988 | Wilson | 404/26 |
| 5,404,676 | * | 4/1995 | Devlin | 49/463 |
| 5,513,926 | * | 5/1996 | Prescott | 404/26 |
| 5,536,110 | * | 7/1996 | Tompkins et al. | 404/25 |
| 5,564,855 | | 10/1996 | Anderson . | |
| 5,956,905 | * | 9/1999 | Wiedrich | 52/20 |

FOREIGN PATENT DOCUMENTS

WO98/35107 8/1998 (WO) .

* cited by examiner

*Primary Examiner*—Eileen D. Lillis
*Assistant Examiner*—Gary S. Hartman
(74) *Attorney, Agent, or Firm*—Swabey Ogilvy Renault

(57) ABSTRACT

Adjustment risers for use in a manhole or catch basin, between a lower support structure, for example, a concrete riser, and an upper frame assembly, adjacent a surface in which the hole is formed, have a molded body and typically are annular; one or more ribs extend outwardly from a first sealing face and a corresponding one or more grooves are formed in an opposed second sealing face, each groove being in opposed relationship with a rib, whereby the adjustment risers may be matingly stacked to provide a required adjustment riser height for a specified manhole or catch basin.

18 Claims, 4 Drawing Sheets

ADJUSTMENT RISER

BACKGROUND OF THE INVENTION a) Field of the Invention

This invention relates to adjustment risers, and more especially to such risers which in use are matingly stacked to occupy a gap between a lower support structure and an upper frame assembly, especially in a manhole or catch basin. This invention further relates to an adjustment riser assembly; an assembly of a lower support structure an upper frame assembly and a stacked multiplicity of risers of the invention; and a method of inhibiting transmission of mechanical vibrations through an upper frame assembly to an adjacent lower support structure.

b) Description of Prior Art

Manholes which provide access to sewers or utility components, and catch basins for removal of rainwater, typically employ a lower support structure, for example, a concrete riser, a frame assembly typically of metal above the lower structure and a removable cover typically of metal to close and permit access to the lower structure and a conduit network communicating with the concrete riser.

A manhole typically has access steps to facilitate entry into the hole.

An adjustment riser is disposed between the lower structure, for example, a concrete riser and the frame assembly. The adjustment riser has two functions, first it occupies the gap between the lower structure and the frame assembly to complete the assembly of the manhole or catch basin, and secondly it absorbs mechanical vibrations developed above the frame assembly, such as by vehicles travelling over the metal cover when the hole is located in a road, and inhibits transmission of the mechanical vibrations to the lower structure, which mechanical vibrations would otherwise cause fractures or cracking in a concrete riser as the lower structure, shortening its life such that frequent repair or replacement becomes necessary.

In that the adjustment riser is to occupy a gap formed in part as a result of a lack of exactness in dimensions of components of the manhole or catch basin; and in part as a result of variations in requirements of different hole structures, such adjustment risers are fabricated in a variety of different thicknesses to accommodate different gap heights between the lower structure and the frame assembly in different holes. An adjustment riser of required thickness or a combination of thicknesses is then selected based on measured dimensions of the gap at a particular hole structure. Thick adjustment risers are heavy and difficult to handle.

SUMMARY OF THE INVENTION

It is an object of this invention to provide an adjustment riser for use in a manhole or catch basin.

It is a particular object of this invention to provide adjustment risers which matingly engage to form a vertical stack and wherein an appropriate number of the risers is employed to occupy the gap formed between a lower structure such as a concrete riser and an above-lying frame assembly.

It is a further object of this invention to provide such adjustment risers which matingly engage to provide lateral stability between adjacent mating risers.

It is a still further object of this invention to provide such adjustment risers which matingly, sealingly engage and are, more particularly self-sealing, thereby inhibiting leakage of water between the adjustment risers to the frame assembly or the lower structure.

It is yet a further object of this invention to provide an adjustment riser assembly comprising a multiplicity of the adjustment risers of the invention.

It is still another object of this invention to provide an adjustment riser assembly that inhibits the flow of subsurface water by creating a seal between the lower structure and the frame assembly of a manhole or catch basin.

It is a further object of this invention to provide improvements in assemblies of lower structures, for example, concrete risers and above-lying frame assemblies, especially in manholes and catch basin structures.

It is a still further object of this invention to provide a method of inhibiting transmission of mechanical vibrations from a frame assembly, especially a metal frame to an under-lying structure, especially a concrete riser, in a manhole or catch basin structure.

In accordance with the invention there is provided an adjustment riser for use in a hole comprising: a molded body having an inner peripheral wall and an outer peripheral wall, said inner peripheral wall defining an orifice, first and second, spaced apart, opposed sealing faces extending between said inner and outer peripheral walls, at least one continuous, elongate rib extending outwardly of said first face and a corresponding number of continuous, elongate grooves in said second face, each at least one rib being in opposed relationship with a said groove and being matingly received by a corresponding groove in a mating riser having a similar molded body.

In accordance with a particular embodiment of the invention there is provided an adjustment riser assembly comprising a multiplicity of adjustment risers of the invention, the risers being matingly, vertically stackable, with the at least one rib of a lower riser matingly received in a corresponding groove in an adjacent upper riser.

In accordance with another aspect of the invention there is provided in an assembly of a lower structure and a frame assembly in which the frame assembly is exposed to vibration generating impacts, the vibrations being transmissible through the frame assembly to the lower structure and wherein an adjustment means is disposed between the frame assembly and the lower structure to absorb mechanical vibrations transmitted through the frame assembly and inhibit transmission of the vibrations to the lower structure, the improvement wherein the adjustment means comprises a vertical stack comprising a multiplicity of risers, each riser being an adjustment riser of the invention as described above, the adjustment risers being matingly stacked to occupy a gap between the frame assembly and the lower structure in which the at least one rib of a lower riser in the stack is matingly received in a corresponding groove in an adjacent upper riser in the stack.

In accordance with still another aspect of the invention there is provided a method of inhibiting transmission of mechanical vibrations through a frame assembly to a lower structure adjacent to the frame assembly comprising disposing a vertical stack comprising a multiplicity of adjustment risers between the frame assembly and the lower structure, the multiplicity absorbing mechanical vibrations transmitted through the frame assembly thereby inhibiting transmission of the vibrations to the lower structure, each riser of the multiplicity being an adjustment riser of the invention as described above, and the adjustment risers being matingly stacked such that a said at least one rib of a lower riser in said stack is matingly received in a corresponding groove in an adjacent upper riser in said stack.

DESCRIPTION OF PREFERRED EMBODIMENTS

The adjustment riser of the invention may be of any ring-like configuration, including circular, elliptical or rectangular, but preferably is formed as an annular molded body. While the adjustment riser may have a single, continuous, elongate rib, and a corresponding single, continuous, elongate groove, in preferred embodiments there are a plurality of parallel, spaced apart ribs and a corresponding plurality of parallel spaced apart grooves.

In the preferred embodiment in which the molded body is annular, the ribs are concentric as are the grooves. Most suitably there are 1 to 5, and preferably 2 to 5 ribs and the same number of grooves, in a particular riser.

The first and second faces of the adjustment riser will be parallel in many cases, however, it is also advantageous to have risers in which one of the first and second faces lies in a plane inclined at an acute angle to a plane containing the other of the faces, such that the riser is of a wedge shape.

Preferably each rib is convexly curved at its outer end, whereas each groove has a flat floor and opposed side walls extending perpendicularly of the flat floor.

However, it will be recognized that other configurations may be employed to provide the mating engagement between adjacent risers of a stack. Thus, the ribs may be convexly curved and the grooves may be concavely curved to match the convex curvature of the ribs.

It is especially preferred that the ribs have a vertical height which is slightly greater than the maximum vertical depth of the grooves. On assembly of the adjustment risers the ribs are deformed, compressed or flattened at their exposed outer end into sealing engagement with the floor of the grooves. This deformation, compression or flattening of the exposed outer end of a rib against the floor of a groove results in a sealing area or sealing zone which inhibits passage of water between adjacent mating adjustment risers.

The sealing between the adjustment risers occurs both at the opposed flat faces of adjacent adjustment risers as well as between the deformed ribs and the floors of the mating grooves, as the load on the stacked adjustment risers increases. The load required to deform the ribs into sealing engagement with the grooves is less than that required for sealing the adjacent risers at their opposed flat faces. In this way the sealing area formed by deformation of the outer ends of the ribs provides the primary seal and the seal formed as opposed flat faces of adjacent risers are pressed together under load creates a secondary seal.

The invention will be further described by reference to the embodiment in which the adjustment risers are employed in a manhole between a lower concrete riser and an upper metal frame which houses a removable closure for the manhole. It will be understood, however, that the invention is also applicable to other hole structures such as catch basins.

In use a multiplicity of the adjustment risers of the invention is employed in a vertical stacked relationship to provide a required riser height to occupy the gap between the lower concrete adjustment riser and the upper metal frame of a manhole. The need to locate an adjustment riser of a necessary thickness is thus avoided and the required thickness or height is developed by stacking the risers. Additionally since the required riser height can be developed by sequential stacking of relatively thin risers, lifting and handling of thick, heavy adjustment risers is avoided.

In the stacking of the adjustment risers, the risers may be disposed so that the ribs are on the upper surface and the grooves are on the lower surface; or the risers may be inverted so that the grooves are on the upper surface and the ribs are on the lower surface.

The invention will be described, for convenience, by reference to the embodiment in which the grooves are on the upwardly facing surface of the riser and the ribs are on the downwardly facing surface of the riser.

In the stacking of the adjustment risers the ribs on the first or lower face of an upper riser of a stack are matingly received in the corresponding grooves of the second or upper face of an adjacent lower riser. In this regard the width of the grooves or the spacing between the side walls of the grooves, is slightly greater than the corresponding thickness dimension of the ribs. Additionally, the convexly curved outer ends of the ribs facilitate mating entry of the ribs into the grooves.

The outer end of each rib forms a seal with the floor of its mating groove, and in the preferred embodiment the outer end of the rib is deformed, compressed or flattened against the groove floor to provide a significant area or zone of sealing contact. The sealing contact in conjunction with close spacing between the rib and the side walls of the groove also provides lateral stability between adjacent adjustment risers; in other words, the tendency of adjacent risers to slide or move laterally to one another is minimized.

In a location in which the maintenance hole is formed in an inclined surface such that the gap between the lower concrete riser and the upper metal frame varies in height in one direction, there may conveniently be employed a wedge-shaped riser of the invention, as the uppermost riser of the stack. In such case the upper or first face of the riser which bears the grooves, is in a plane which is inclined at an acute angle to the plane containing the lower or second face in which the ribs are formed and this latter face in use will be generally parallel with the faces of the lower risers of the stack.

A plurality of such wedge-shaped risers may be employed to achieve a desired correction to provide a top face in a horizontal plane.

The adjustment riser is suitably a compression molded body which may be formed from various resilient materials, especially elastomeric materials, for example, neoprene, styrene-butadiene rubber, EPDM (a terpolymer formed from ethylene-propylene diene monomer), masticated rubber compound, virgin rubber or recycled rubber.

The compression molded body has resilience and flexibility and can be physically compressed in a limited way.

DESCRIPTION OF PREFERRED EMBODIMENTS WITH REFERENCE TO THE DRAWINGS

Figure 1:
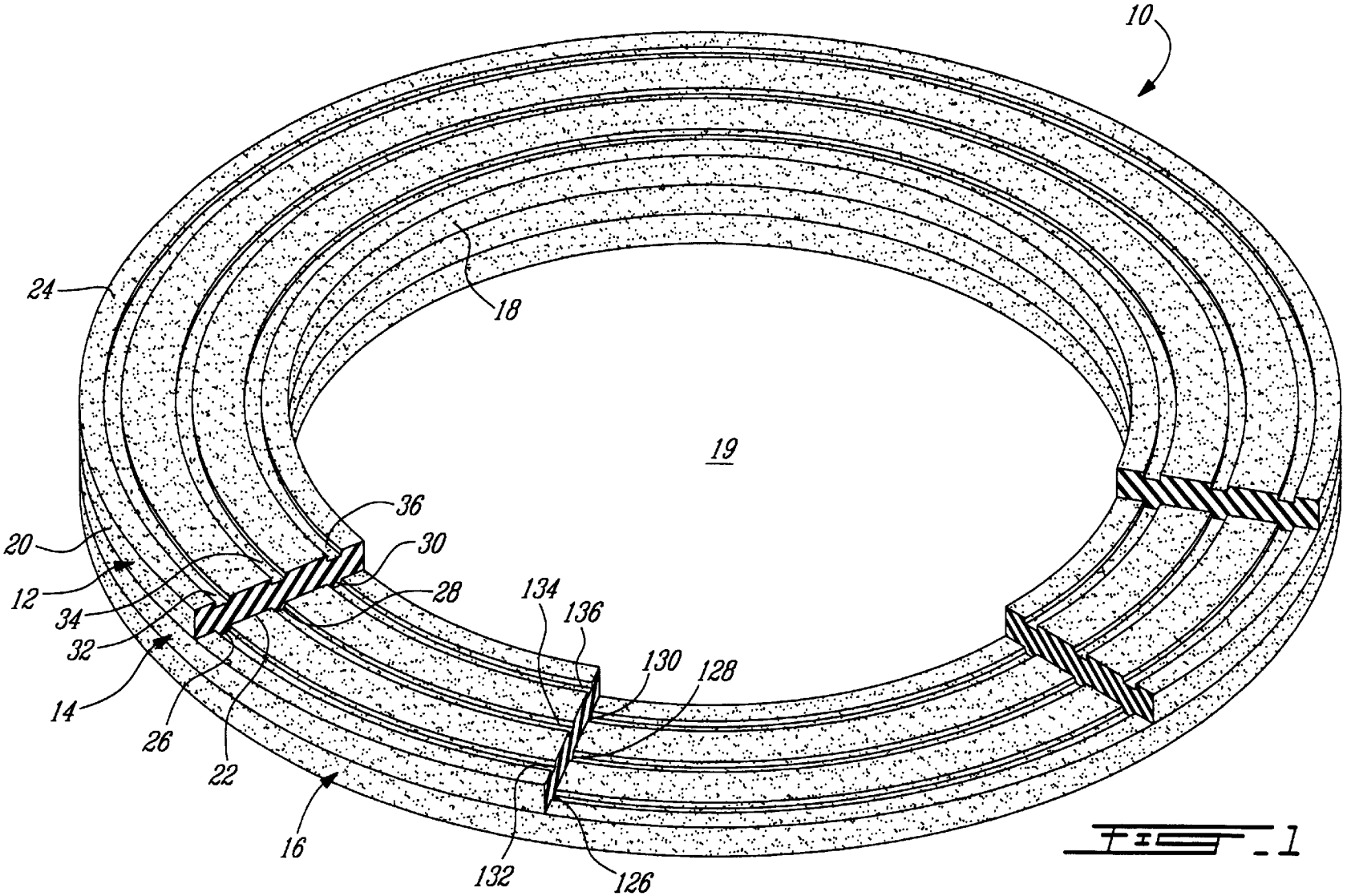
FIG. 1 is a perspective view, part cut away of a stack of adjustment risers of the invention.

With further reference to FIG. 1, an assembly 10 comprises adjustment risers 12, 14 and 16 in a stacked mating relationship.

The risers 12, 14 and 16 are of the same form. Thus riser 12 comprises an annular molded body having an inner peripheral wall 18 and an outer peripheral wall 20. Wall 18 defines an orifice 19.

A lower sealing face 22 and an upper sealing face 24 extend between the peripheral walls 18 and 20. Elongate ribs 26, 28 and 30 extend outwardly in spaced apart, parallel, concentric relationship from lower face 22; and elongate grooves 32, 34 and 36 extend inwardly of upper face 24. The grooves 32, 34 and 36 have the same spaced apart, parallel, concentric relationship as the ribs 26, 28 and 30; and are in opposed relationship with ribs 26, 28 and 30.

It will be understood that the risers 12, 14 and 16, could be inverted so that the face 22 is the upper face and elongate ribs 26, 28 and 30 extend upwardly and the face 24 is the lower face and grooves 32, 34 and 36 face downwardly.

Figure 2:
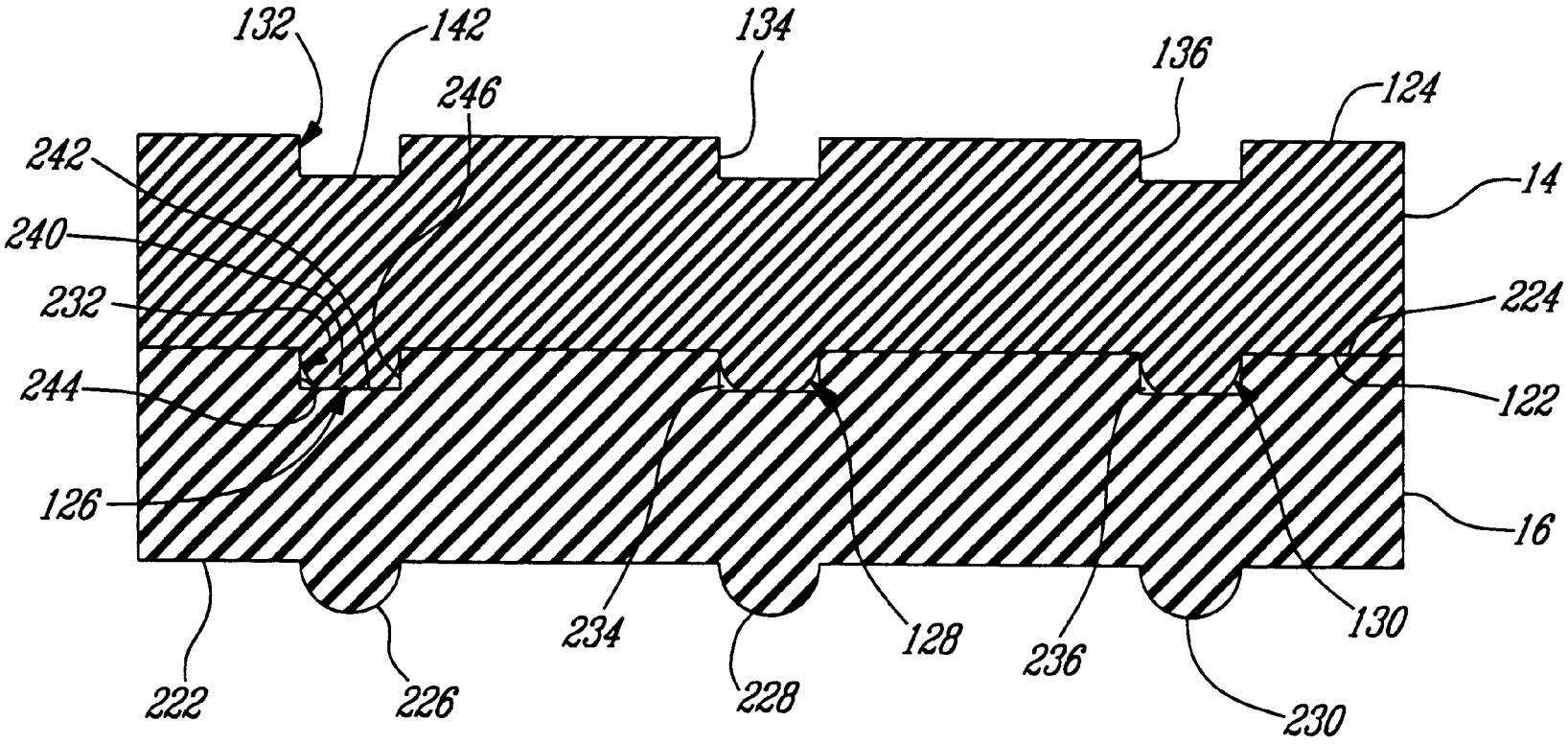
FIG. 2 is a cross-section on line 2—2 of FIG. 1.

The risers 14 and 16 are of the same form as riser 12, as more particularly shown in FIG. 2. Riser 14 has ribs 126, 128 and 130 and grooves 132, 134 and 136 corresponding to those of riser 12; and riser 16 has ribs 226, 228 and 230 and grooves 232, 234 and 236 corresponding to those of riser 12.

The stacked mating relationship of the risers 12, 14 and 16 in the assembly 10 is more particularly illustrated for risers 14 and 16 in FIG. 2.

With further reference to FIG. 2, the lower face 124 of riser 14 engages the upper face 222 of riser 16, with ribs 226, 228 and 230 of riser 16 matingly received in grooves 132, 134 and 136, respectively of riser 14.

As can be seen in FIG. 2, rib 126 has a convexly curved outer end 240. The other ribs are of similar form. Furthermore, groove 232 has a generally flat floor 242 and perpendicular side walls 244 and 246. The other grooves are of similar form. The distance between side walls such as 244 and 246 of the grooves is slightly greater than the width of the ribs such as 226.

Conveniently the grooves such as 132 in riser 14 have a depth slightly less than the height of a rib such as 226 in riser 16, so that the resilience of the molded body of the risers such as 16, in conjunction with the weight of the risers such as 14, deforms or compresses and flattens the convexly curved outer ends of the ribs such as 226, when the risers are stacked.

In this way, by reference to FIG. 2, upper face 124 of riser 14 is supported in sealing engagement with lower face 222 of riser 16 and ribs 226, 228 and 230 of riser 16, sealingly engage the groove floors such as floor 142 of groove 132.

Additionally the close spacing of groove side walls such as those of groove 132 with a mating rib 226 provides lateral stability.

As explained hereinbefore the structures illustrated in FIGS. 1 and 2 may be inverted in use so that the grooves, for example, 132, 134 and 136 face downwardly and the ribs, for example, 226, 228 and 230 face upwardly.

Figure 3:
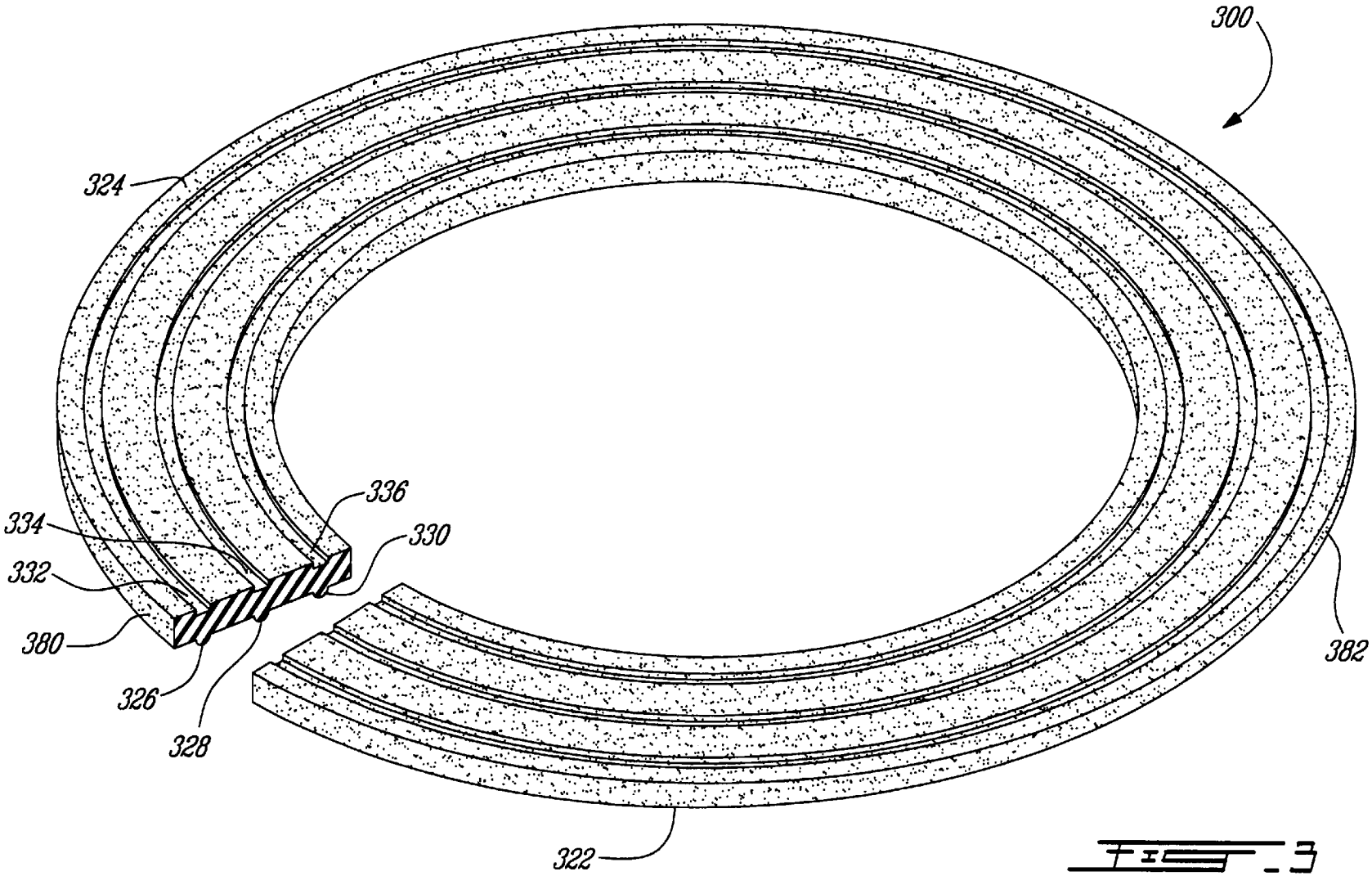
FIG. 3 is a perspective view, somewhat exaggerated, of a wedge-shaped adjustment riser of the invention.

With further reference to FIG. 3, a wedge shaped riser 300 is of the same form as riser 12 having ribs 326, 328 and 330, and grooves 332, 334 and 336, but has a thickness which varies in one direction form a thick end 380 to a thin end 382, face 322 being inclined at an acute angle to face 324.

Riser 300 may be employed in conjunction with risers such as 12, 14 and 16 to accommodate variation in height of a gap to be occupied by the risers in a manhole.

A plurality of stacked wedge shaped risers 300 may be employed so that the upper face of the stack of risers is in a horizontal plane, or to introduce a required slope in the assembly, supported by the adjustment risers, more especially the cover, to match a slope in the road.

Figure 4:
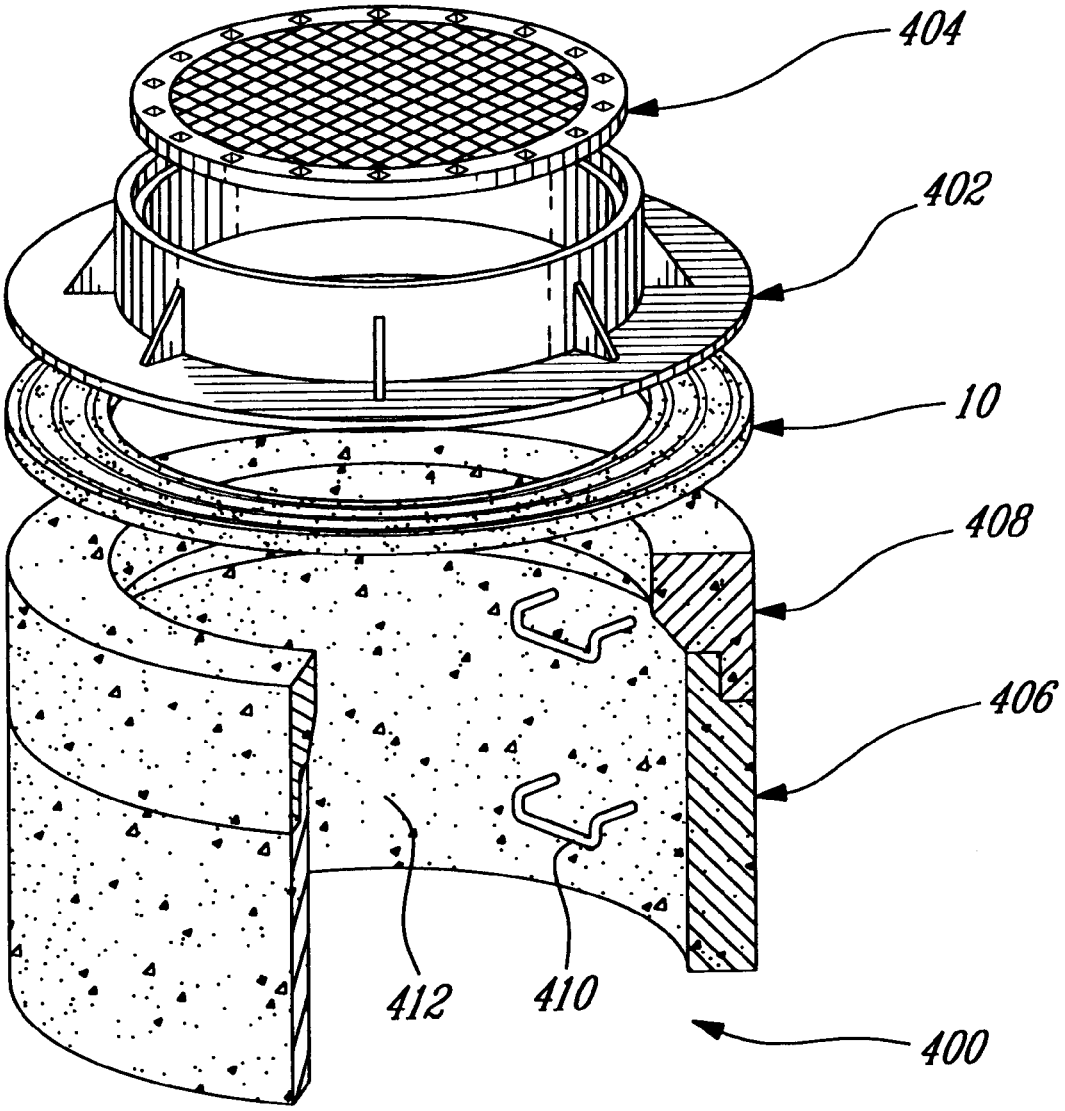
FIG. 4 is a perspective view, in partial cross-section of a manhole assembly in an embodiment of the invention.

With further reference to FIG. 4, there is shown an exploded view of a manhole 400 which typically will be in a road surface (not shown).

The manhole 400 has a metal manhole frame 402 having a metal cover 404 and concrete risers 406 and 408, access steps 410 are located on an inner wall 412 defined by concrete risers 406 and 408.

An adjustment assembly 10 of FIG. 1 is disposed between metal manhole frame 402 and concrete riser 408.

In use vehicles travelling on the road in which the manhole 400 is located impact metal cover 404 and the upper rim of metal frame 402 and develop mechanical vibrations which are transmitted through metal frame 402 towards concrete riser 408.

The mechanical vibrations are absorbed by the adjustment assembly 10 and the transmission of vibrations to concrete riser 408 is prevented or inhibited, thereby preventing damage to concrete riser 408.

The mating, sealing engagement between adjacent adjustment risers in adjustment assembly 10 provides a sealed assembly which substantially inhibits passage of water between the risers, thereby minimizing access of water to the subsurface structures.

The adjustment assembly 10 is readily varied for different manhole structures, by use of the appropriate number of risers such as 12, 14 and 16, in stacked, mating relationship to occupy the gap formed between the concrete risers below the ground, for example, below a road surface and the metal frame disposed adjacent the surface. Where the surface is inclined such that the gap between the upper concrete riser and the metal frame varies in one direction, one or more a wedge-shaped risers such as 300 are included in the stacked assembly, especially as the uppermost riser.

In a particular embodiment, included here for the purpose of illustration or exemplification, the riser 12 has an inner peripheral wall having a radius of 12 inches and an outer peripheral wall having a radius of 18 inches; the ribs 26, 28 and 30 have a width of about 0.5 inches and a height of about 0.25 inches, whereas the grooves 32, 34 and 36 have a width of about 0.625 inches and a depth of about 0.1875 inches. The riser 12 has a thickness measured between the upper and lower faces 22 and 24 of 1 inch. The rib 30 is 0.5 inches from the inner peripheral wall, the rib 28 is spaced 1.5 inches from rib 30 and the rib 26 is spaced 1.5 inches from rib 28.

It will be recognized that variations in the structure and composition as described hereinbefore, may be made without departing from the invention.

What is claimed is:

1. An adjustment riser for use in a hole comprising:

a molded body having an inner peripheral wall and an outer peripheral wall, said inner peripheral wall defining an orifice, first and second, spaced apart, opposed sealing faces extending between said inner and outer peripheral walls, at least one continuous, elongate rib extending outwardly of said first face and a corresponding number of continuous, elongate grooves in said second face, each at least one rib having a convexly curved outer end, and a vertical height greater than the corresponding vertical depth of a mating groove of a mating riser, each groove having a flat floor and opposed side walls extending from said flat floor, each at least one rib being in opposed relationship with a said groove, and being sealingly matingly received by a corresponding groove in a mating riser having a similar molded body, such that in mating the convexly curved outer end of each rib is deformed into sealing engagement with the flat floor of the mating groove between said opposed side walls of said mating groove.

2. An adjustment riser according to claim 1, wherein said molded body is annular, said first face having a plurality of spaced apart, elongate, parallel concentric ribs extending outwardly thereof, and said second face having a same plurality of spaced apart, elongate, parallel, concentric grooves therein, each rib of said plurality being in opposed relationship with a groove of said same plurality.

3. An adjustment riser according to claim 2, wherein said plurality is 2 to 5.

4. An adjustment riser according to claim 3, wherein said molded body is a compression molded body of neoprene, styrene-butadiene rubber, EPDM, masticated rubber compound, virgin rubber or recycled rubber.

5. An adjustment riser according to claim 2, wherein said first and second faces are parallel.

6. An adjustment riser according to claim 2, wherein one of said first and second faces lies in a plane inclined at an acute angle to a plane containing the other of said faces, such that said riser is wedge-shaped.

7. An adjustment riser according to claim 2, wherein in each groove said opposed side walls extend perpendicularly of said flat floor.

8. An adjustment riser according to claim 1, wherein said molded body is a neoprene.

9. An assembly according to claim 1, wherein the opposed side walls of each groove are closely spaced to its mating rib during mating so as to provide lateral stability between the risers in the assembly.

10. An adjustment riser assembly comprising a multiplicity of risers as defined in claim 1, said risers being matingly, vertically, stackable with the at least one rib of a lower riser matingly received in a corresponding groove in an adjacent upper riser.

11. An assembly according to claim 10, wherein the molded body of each riser is annular, each riser having a said first face with a plurality of spaced apart, elongate, parallel, concentric ribs extending outwardly thereof, and a said second face with a same plurality of spaced apart, elongate, parallel, concentric grooves therein, each rib of said plurality being in opposed relationship with a groove of said same plurality.

12. An assembly according to claim 11, wherein at least one of said risers has one of said first and second faces lying in a plane inclined at an acute angle to a plane containing the other of said faces, such that said at least one riser is wedge-shaped, the others of said risers each having parallel first and second faces.

13. In an assembly of a lower structure and an upper frame assembly in which the frame assembly is exposed to vibration generating impacts, the vibrations being transmissible through said frame assembly to said lower structure, and wherein an adjustment means is disposed between said frame assembly and said lower structure to absorb mechanical vibrations transmitted through said frame assembly and inhibit transmission of the vibrations to the lower structure, the improvement wherein said adjustment means comprises a vertical stack comprising a multiplicity of risers, each riser comprising:

a molded body having an inner peripheral wall and an outer peripheral wall, said inner peripheral wall defining an orifice, first and second, spaced apart, opposed sealing faces extending between said inner and outer peripheral walls, at least one continuous, elongate rib extending outwardly of said first face and a corresponding number of continuous, elongate grooves in said second face, each at least one rib having a convexly curved outer end, and a vertical height greater than the corresponding vertical depth of a mating groove of a mating riser, each groove having a flat floor and opposed side walls extending from said flat floor, each at least one rib being in opposed relationship with a said groove, and being matingly received by a corresponding groove in a mating riser having a similar molded body, and wherein said risers are sealingly matingly stacked to occupy a gap between said frame assembly and said lower structure in which said at least one rib of a lower riser in said stack is matingly received in a corresponding groove in an adjacent upper riser in said stack, such that in mating the convexly curved outer end of each rib is deformed into sealing engagement with the flat floor of the mating groove between said opposed side walls of said mating groove.

14. An assembly according to claim 13, wherein said molded body of each said riser is annular, said first face having a plurality of spaced apart, elongate, parallel, concentric ribs extending outwardly thereof, and said second face having a same plurality of spaced apart, elongate, parallel, concentric grooves therein, each rib of said plurality being in opposed relationship with a groove of said same plurality.

15. An assembly according to claim 14, wherein said lower structure is a concrete riser and said frame assembly is of metal.

16. An assembly according to claim 14, wherein said plurality is 2 to 5; and the side walls of each groove are closely spaced to its mating rib during mating so as to provide lateral stability between the risers in the assembly.

17. An assembly according to claim 16, wherein said molded body is of neoprene.

18. A method of inhibiting transmission of mechanical vibrations through a frame assembly to a lower structure adjacent to the frame assembly comprising disposing a vertical stack comprising a multiplicity of adjustment risers between the frame assembly and the lower structure, said multiplicity absorbing mechanical vibrations transmitted through the frame assembly thereby inhibiting transmission of the vibrations to the lower structure, each riser of said multiplicity comprising:

a molded body having an inner peripheral wall and an outer peripheral wall, said inner peripheral wall defining an orifice, first and second, spaced apart, opposed sealing faces extending between said inner and outer peripheral walls, at least one continuous, elongate rib extending outwardly of said first face and a corresponding number of continuous, elongate grooves in said second face, each at least one rib having a convexly curved outer end, and a vertical height greater than the corresponding vertical depth of a mating groove of a mating riser, each groove having a flat floor and opposed side walls extending from said flat floor, each at least one rib being in opposed relationship with a said groove, and being matingly received by a corresponding groove in a mating riser having a similar molded body, and wherein said risers are sealingly matingly stacked such that a said at least one rib of a lower riser in said stack is matingly received in a corresponding groove in an adjacent upper riser in said stack, such that in mating the convexly curved outer end of each rib is deformed into sealing engagement with the flat floor of the mating groove between said opposed side walls of the mating groove.

* * * * *